United States Patent [19]

Fackler

[11] 4,103,621

[45] Aug. 1, 1978

[54] WAD COLUMN FOR SHOTSHELLS

[76] Inventor: David G. Fackler, 16230 Fifth Ave., North, Wayzata, Minn. 55391

[21] Appl. No.: 706,219

[22] Filed: Jul. 19, 1976

[51] Int. Cl.[2] ..... F42B 7/08

[52] U.S. Cl. ..... 102/95

[58] Field of Search ..... 102/95, 42 C

[56] References Cited

U.S. PATENT DOCUMENTS

| | | | |
|---|---|---|---|
| 997,566 | 7/1911 | Leach | 102/95 |
| 3,115,835 | 12/1963 | Currie | 102/95 |
| 3,266,421 | 8/1966 | Comerford | 102/95 |
| 3,270,669 | 9/1966 | Atkins et al. | 102/95 |
| 3,309,994 | 3/1967 | Lage | 102/95 |

*Primary Examiner*—Charles T. Jordan

*Attorney, Agent, or Firm*—H. Dale Palmatier

[57] ABSTRACT

A shotshell wad column including a cup with a tapered peripheral wall and a dome-shaped bottom wall, the concave side of which faces the open mouth of the cup, and a card wad lying against the bottom wall and defining an air chamber between the card wad and the bottom wall.

2 Claims, 3 Drawing Figures

WAD COLUMN FOR SHOTSHELLS

This invention relates to a wad column for shotshells.

BACKGROUND OF THE INVENTION

Although the shotshells presently available are capable of propelling shot to long ranges, difficulty is experienced in keeping the shot column together at ranges of 45 to 90 yards as to maintain a shot pattern capable of killing geese. There have been a multitude of different wad columns devised and used in recent years, but none with significant success for these purposes. Among such prior wad columns are those illustrated in U.S. Pat. Nos. 419,220; 974,369; 3,309,994; 3,422,762; 3,722,420; 3,575,113; and 3,881,418.

BRIEF SUMMARY OF THE INVENTION

The wad column of the present invention includes a long molded plastic cup to maintain the shot column away from the shotgun barrel wall, thereby preventing shot deformation by abrasion and pressure on the wall. The cup defines a lower skirt to seal against the shotshell case and barrel wall.

The bottom wall of the cup is domed or cone-shaped with the concave side facing into the shot chamber of the cup. An air chamber is defined adjacent the bottom wall by a hard and flat fiber or nitro wad which extends entirely across the interior of the cup.

Adjacent the periphery of the nitro wad, the circumferential wall of the cup has a substantial thickness and much greater thickness than at the open mouth of the cup. Accordingly, the inner peripheral surface of the cup wall tapers divergently from the bottom wall of the cup to the open mouth. The amount of taper of the inner peripheral cup wall surface is sufficient as to prevent the cup wall from restricting outward flow of shot from the cup or from allowing the shot to freely adjust as the cup and shot pass through the choke restriction in the shotgun barrel.

Relative to the choke restriction in the barrel which tapers convergently toward the barrel muzzle, the inner peripheral cup wall surface tapers oppositely, diverging toward the barrel muzzle. As the cup and shot are propelled through the choke restriction, the cup wall is progressively deformed.

The outer or open end of the cup wall is initially constricted by the barrel choke. However, because the amount of taper at the inner periphery of the cup wall is greater than the taper in the choke restriction, the inner periphery of the cup wall continues to be tapered divergently toward the barrel muzzle all throughout the time that the cup and shot charge is moving through the choke restriction. Movement of the shot in the cup will not be impeded by passage of the cup through the choke restriction.

Also as the shot charge and cup are being propelled along the barrel, the initial shock of acceleration of the cup, nitro wad and shot charge, is largely absorbed by deformation of the nitro wad, which seals tightly against the periphery of the bottom cup wall and which also tends to compress the entrapped air in the adjacent air chamber. Such deformation of the nitro wad and the substantial collapse of the air chamber combines to significantly reduce the amount of pressure on the shot and deformation of the shot at the bottom of the shot cup.

The result is that the shot charge effectively holds together at long range for a surprisingly good game killing capability. It has been observed that at such long ranges, a substantial percentage of the shot in the pattern, within a 30 inch circle, originated at the bottom of the shot charge in the cup, adjacent the nitro wad. As the range is increased, the center pattern density is increased and the percentage of shot in the pattern which originated in the bottom of the cup adjacent the wad is also increased.

DETAILED DESCRIPTION OF THE INVENTION

Figure 1:
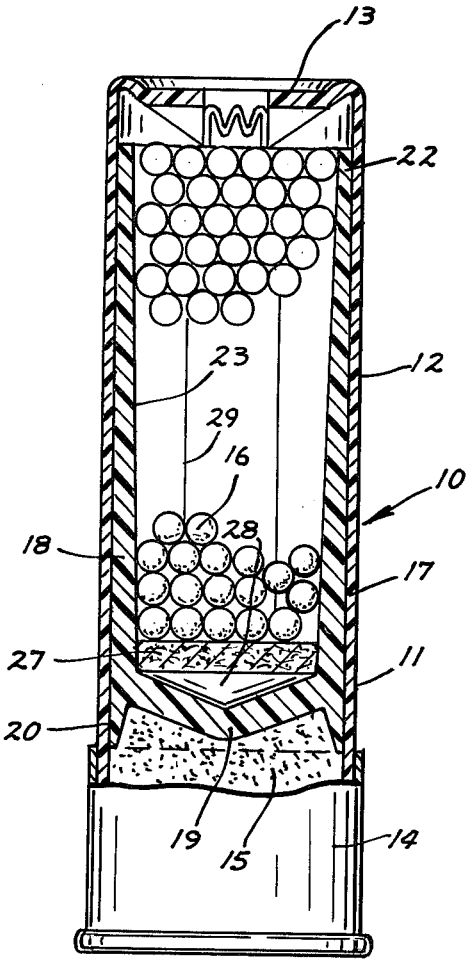
FIG. 1 is an elevation view of a shotshell, partly broken away and shown in longitudinal section and embodying the wad column constituting the present invention.
Figure 2:
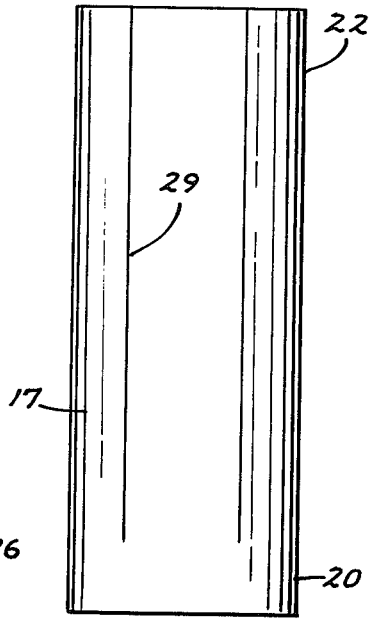
FIG. 2 is an elevation view of the plastic shot cup forming a part of the wad column, and separate from the shotshell.

One form of the present invention is illustrated in the drawings and is described herein.

A typical shotshell is illustrated in FIG. 1 and is indicated in general by numeral 10. The shotshell includes a shotshell case 11 having a tubular wall 12, the front end portion 13 of which is crimped over to close the interior of the shell. The shotshell case also includes a metal base cap 14 which carries the primer. A powder charge 15 is confined in the base portion of the interior of the shotshell case, and a shot charge 16 is also a conventional part of the shotshell. Usually the shot is lead, but may be steel in some instances.

The present invention relates to the wad column for the shotshell and includes a shot cup which is indicated in general by numeral 17. The shot cup is preferably molded of a soft and resilient plastic such as low density polyethylene and is formed integrally and in one piece. In some instances the material may be other plastics material, such as high density polyethylene or other plastics with similar or other desirable characteristics. The cup 17 has a peripheral side wall 18 and a bottom wall 19 which is formed integrally and in one piece with the side wall 18. Immediately adjacent the bottom wall 19, the rear or lower end 20 of the cup wall tapers sharply to a thin edge so as to define a sealing skirt which easily flexes outwardly and effectively seals against the case wall 12 and the shotgun barrel 21 when the powder charge 15 is ignited so as to prevent loss of pressure created by the rapidly burning powder charge which propels the shot charge and wad column out of the barrel.

It will be noted that the bottom wall 19 is substantially dome-shaped with the concave side of the bottom wall facing the open mouth end 22 of the peripheral cup wall 18. More specifically, the dome-shaped bottom wall 19 is substantially cone-shaped, and has a slightly rounded apex. It will be observed that the bottom wall 19 has a thickness of the same order of magnitude as the thickness of the adjacent portions of the peripheral side wall 18, but it will also be recognized that the bottom wall 19 is slightly thicker than the thickest portion of the peripheral cup wall 18. At the outer peripheral portions of the bottom wall 19, the bottom wall joins the peripheral cup wall in a sharply angular or obliquely angular relation.

Figure 3:
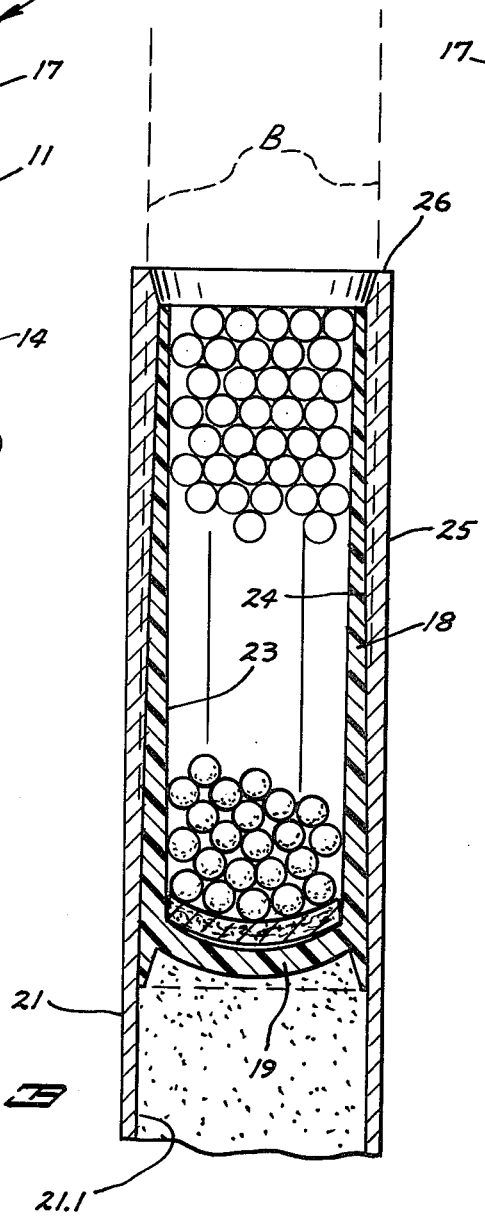
FIG. 3 is a longitudinal section view of the wad column shot charge passing through the full choke restriction of a shotgun barrel under propulsion by rapidly burning powder.

The peripheral cup wall 18 has a significant taper at its inner surface 23 which tapers divergently from the bottom wall 19 to the open mouth end 22 of the peripheral wall 18. The amount of the taper of the inner peripheral surface 23 is significantly greater than the taper of the inner barrel surface 24 in the area of the choke restriction 25 adjacent the muzzle 26 of the shotgun barrel 21. In FIG. 3 the inner tapering surface 24 of the barrel wall at the choke restriction 25 tapers convergently toward the muzzle 26. However, because the taper of the inner surface 23 of the cup wall 18 is at a substantially greater angle than the taper of the inner choke restriction surface 24 of the barrel, the inner surface 23 of the cup wall 18 continues to be tapered divergently toward the muzzle end of the barrel while the cup and shot charge pass through the choke restriction 25 of the barrel.

The wad column also includes a hard cardboard or fiber wad 27 of the type which is known to persons of skill in the art as a nitro wad. The wad 27 is of such a diameter as to fit snugly within the interior periphery of the cup wall 18 adjacent the bottom wall 19, and the wad 27 rests upon the peripheral portions of the bottom wall 19 of the cup. The shot charge 16 rests upon the wad 27, and, as illustrated in FIG. 1, the wad 27 cooperates with the bottom wall 19 in defining a cavity or air chamber 28.

Such card wads 27 come in various thicknesses, and any of a number of various thicknesses of card wads in the range of 0.070 to 0.200 inches have been successfully employed. The selection of the thickness of the card wad depends partly upon the quantity of shot desired in the shot charge 16.

The shot cup 17 is preferably provided with longitudinally extending slits 29 to allow the forward portions of the peripheral cup wall to flex outwardly after the wad column and shot charge is propelled forwardly of the barrel muzzle 26.

It has been found that the present invention is particularly useful in larger types of shotshells, such as 10 gauge shotgun shells, and the outer diameter of the cup 17 adjacent the bottom wall 19 has an outer diameter typically in the range of 0.770 inches, and, although the cup may have various lengths, a length of 2.125 inches is found to be satisfactory for many loads. It has been found satisfactory to vary the thickness of the peripheral side wall 18 of the cup 17 from approximately 0.080 adjacent the bottom wall 19 to approximately 0.020 at the open mouth end of the peripheral side wall 18. The bottom wall 19 has been found to be satisfactory at a thickness of approximately 0.090 inches.

In FIG. 3, the inner barrel surface 21.1 of the barrel 21 is cylindrical throughout substantially its entire length, except for the taper at the choke restriction 25. For size comparison purposes, the projection of the inner barrel surface is indicated by the dotted lines B in FIG. 3. The internal diameter of the cylindrical barrel wall 21.1 is typically in the range of 0.775 in a 10 gauge shotgun barrel. The barrel is constricted by approximately 0.041 inches in diameter at the full choke constriction defined by the inner tapered surface 24 of the barrel in a 10 gauge shotgun barrel.

When the shotshell employing the present wad column is loaded into a shotgun and fired, the ignition of the powder charge 15 creates very significant gas pressure in the shotshell case and the barrel and produces extremely rapid acceleration of the wad column and shot charge toward the muzzle of the barrel. As the pressures suddenly build up and acceleration of the wad column and shot charge increases, the reaction in the shot charge causes considerable pressure between the individual shot in the charge, and also causes the shot to bear with very significant force against the wad 27 and against the peripheral cup wall 18. Accompanying the rapid buildup of pressure between adjacent shot will be a substantial increase in temperatures in the shot as well. Individual shot will tend to embed into the wad 27 and into the peripheral cup wall 18, and, of course, during this pressure, there will be some limited jostling of the shot in the charge adjacent the wad 27. As illustrated in FIG. 3, the combined effect of the gas pressure below the bottom wall 19 and the reaction of the shot charge in the interior of the cup causes the wad 27 to be deformed and causes the air chamber 28 to be at least partially closed or collapsed. There will be some deformation of the bottom wall 19, but the bottom wall 19 will retain its general dome-shaped configuration, although the bottom wall 19 may vary from its original conical configuration into a somewhat more rounded dome shape to accommodate all of the pressures involved.

The effect of the collapse of the air chamber 28 and the deformation of the card wad 27 is the easing or minimization of the rapid buildup of pressures against the shot in the shot charge, and, because of the tapering cup wall and its somewhat thicker shape adjacent the bottom wall 19, there is essentially no likelihood that individual shot will force its way through the peripheral wall 18 to abrade against the barrel wall.

It has been found that this wad column contributes materially to the maintenance of an effective killing pattern of shot at longer ranges from 45 to 90 yards. It has been found that the shot which originate the lower portion of the shot charge, adjacent the card wad 27, constitute the predominant shot maintained in the pattern within a 30 inch circle at ranges in excess of 45 yards. In such firings of two ounce loads of number 2 copper plated shot wherein the shot charge originally contained 176 pieces of number 2 shot, the 35 pellets next adjacent the card wad 27 were coated with red rouge so as to be identifiable in the pattern target at the ranges in excess of 45 yards. It was found that, over a number of firings, with this wad column, 93 percent of the total number of shot in the charge were found within a 30 inch circle at a range of 45 yards. In addition, of the total number of shot found in the pattern within a 30 inch circle, 45 percent of the shot are made up of those shot which originated adjacent the bottom of the shot charge, adjacent the wad 27. Although only 20 percent of the shot in the charge were coated with red rouge, and placed next adjacent the card wad 27, 45 percent of the total pattern within a 30 inch circle at 45 yards were noted to have the red rouge. It is believed that this relationship is striking and unexpected and is produced substantially entirely because of the wad column herein described.

As the wad column and the shot charge are moved rapidly through the shotgun barrel, the divergent taper at the inner surface of the peripheral cup wall is maintained until the shot charge and wad column clear the end of the barrel muzzle so that there is no tendency to restrict, as by means of the choke, the movement of the pellets in the cup and the pellets are free to start moving with respect to the cup 17 as the shot charge and cup encounter the choke and as the charge and cup exit the barrel muzzle.

It will be seen that I have provided a new and improved wad column which has proven effective for producing a more concentrated pattern at longer ranges for shooting game birds such as geese. The wad column includes a plastic shot cup with a transverse bottom wall and a sealing skirt, and a card wad or nitro wad in the bottom of the cup and cooperating with the bottom wall of the cup to define a cushioning air chamber. The peripheral cup wall has an inner peripheral surface which tapers divergently toward the open mouth of the shot cup and with a significant taper which is substantially greater angle than the constriction formed at the choke of the shotgun barrel.

What is claimed is:

1. A wad column for a shotshell and a shotgun with a full choke barrel incorporating a tapered choke restriction, the wad column comprising:

a resiliently flexible molded plastic shot cup having a peripheral cup wall and a transverse bottom wall formed integrally and in one piece with the peripheral wall and extending entirely across the peripheral wall, the peripheral wall having an outer open mouth end and an inner sealing skirt end adjacent the bottom wall, the bottom wall being dome-shaped with a concave side facing the open mouth end of the peripheral wall, the bottom wall having an obliquely angular relation to the adjacent peripheral cup wall, the peripheral wall progressively increasing in thickness from the open mouth end to the bottom wall to the extent that the inner peripheral surface of the cup wall tapers conically and divergently toward the open mouth end, the peripheral cup wall having slits extending from the open mouth end substantially to the bottom wall; and a hard cardboard wad in the cup and bearing against the entire periphery of the dome-shaped bottom wall and cooperating therewith to define an air chamber, and the bottom wall supporting the periphery of the wad and facilitates efficient sealing between the wad and bottom wall, and the cardboard wad deforming under pressure of rapid acceleration in the shotgun barrel to at least partially collapse the air chamber and reduce pressures upon the shot in the cup.

2. A wad column for a shotshell and a shotgun with a full choke barrel incorporating a tapered choke restriction, the wad column comprising:

a resiliently flexible molded plastic shot cup having a peripheral wall and a transverse bottom wall formed integrally and in one piece with the peripheral wall and extending entirely across the peripheral wall, the peripheral wall having an outer open mouth end and an inner sealing skirt end adjacent the bottom wall, the bottom wall being dome shaped with a concave side facing the open mouth end of the peripheral wall, the dome-shaped bottom wall being substantially cone-shaped with a rounded apex, the peripheral wall progressively increasing in thickness from the open mouth end to the bottom wall to the extent that the inner peripheral surface of the cup wall tapers conically and divergently toward the open mouth end, the peripheral cup wall having slits extending from the open mouth end substantially to the bottom wall; and a hard cardboard wad in the cup and bearing against the entire periphery of the dome-shaped bottom wall and cooperating therewith to define an air chamber, and the dome-shaped bottom wall cooperating with the wad and air in the air chamber to resist deformation during rapid acceleration in the shotgun barrel, and the cardboard wad deforming under pressure of rapid acceleration in the shortgun barrel to at least partially collapse the air chamber and reduce pressures upon the shot in the cup.

* * * * *